US005295857A

United States Patent [19]

Toly

[11] Patent Number: 5,295,857

[45] Date of Patent: Mar. 22, 1994

[54] ELECTRICAL CONNECTOR WITH IMPROVED WIRE TERMINATION SYSTEM

[76] Inventor: Elde V. Toly, 109 Bulkley Ave., Sausalito, Calif. 94965

[21] Appl. No.: 995,823

[22] Filed: Dec. 23, 1992

[51] Int. Cl.[5] ..... H01R 4/24

[52] U.S. Cl. ..... 439/395; 439/417; 439/488; 439/596

[58] Field of Search ..... 439/395, 404, 411, 412, 439/417, 431, 467, 488, 489, 596, 752

[56] References Cited

U.S. PATENT DOCUMENTS

| | | | |
|---|---|---|---|
| 3,184,704 | 5/1955 | Raymond et al. . | |
| 3,760,334 | 9/1973 | Bridle | 439/417 |
| 3,768,067 | 10/1973 | Rault | 439/412 |
| 4,217,022 | 8/1980 | Carre . | |
| 4,243,287 | 1/1981 | Smith et al. . | |
| 4,444,448 | 4/1984 | Silbernagel et al. . | |
| 4,449,767 | 5/1984 | Weidler . | |
| 4,504,104 | 3/1985 | Leong et al. . | |
| 4,533,199 | 8/1985 | Feldberg . | |
| 4,537,456 | 8/1985 | Brown et al. . | |
| 4,555,158 | 11/1985 | Lam . | |
| 4,679,881 | 7/1987 | Galvin et al. | 439/392 |
| 4,691,977 | 9/1987 | Marzili et al. | 439/404 |
| 4,695,113 | 9/1987 | Eckhaus | 439/404 |
| 4,701,138 | 10/1987 | Key | 439/417 |
| 4,714,306 | 12/1987 | Miyazawa et al. | 439/395 |
| 4,822,300 | 4/1989 | Gerke et al. | 439/417 |
| 4,834,669 | 5/1989 | Siemon et al. | 439/395 |
| 4,834,670 | 5/1989 | Rodondi et al. | 439/398 |
| 4,915,645 | 4/1990 | Konnemann et al. | 439/417 |
| 4,954,098 | 9/1990 | Hollingsworth | 439/404 |
| 4,981,443 | 1/1991 | Suverison et al. | 439/398 |
| 5,062,804 | 11/1991 | Jamet et al. | 439/394 |
| 5,154,632 | 10/1992 | Ijiri | 439/394 |

FOREIGN PATENT DOCUMENTS

| | | | |
|---|---|---|---|
| 2562337 | 10/1985 | France | 439/417 |

*Primary Examiner*—Larry I. Schwartz
*Assistant Examiner*—Khiem Nguyen
*Attorney, Agent, or Firm*—Owen, Wickersham & Erickson

[57] ABSTRACT

An electrical plug connector adapted for connection with individual insulated wires of an electrical conduit comprises a housing having a plurality of elongated chambers each in line with a coupling element fixed in the housing. Each coupling element includes an elongated bifurcated jaw section having opposed inner knife edges that extend within an elongated chamber. A movable block within each housing chamber includes a first hole for receiving the end of an insulated wire to be terminally attached to a coupling element and a second hole for receiving a tool adapted to move the slider block within its chamber toward the jaw section of a coupling element so that the insulated wire previously placed within the slider block will move between the knife edges of the jaw section to provide an electrical contact. When each slider block is locked into its wire contacting position, the housing is closed and the connector is ready for use.

12 Claims, 6 Drawing Sheets

ELECTRICAL CONNECTOR WITH IMPROVED WIRE TERMINATION SYSTEM

This invention relates to electrical plug type connectors and more particularly to an electrical plug connector with an improved internal wire termination system.

BACKGROUND OF THE INVENTION

In the field of electrical connectors and couplings several techniques have been developed for connecting flexible, current carrying, wires to terminals in connectors and receptacles. Such wire to terminal connections have included ring terminal and screw connectors using a pressure plate, wire bearing screw terminals, compression terminals and the simple wind around screw technique. All of these earlier prior art wire to terminal connection structures had one or more serious disadvantages. Such disadvantages, included the necessity to remove wire insulation, to bend the wire in a certain manner, to install and/or tighten terminal screws and to provide wire guidance to the exterior of the connectors as heretofore devised, required a considerable amount of time to facilitate the terminal connection of conductor wires in a plug connector unit. Also, after the installation procedure, the reliability and endurance of the electrical connection between wire and terminal within the device was often less than adequate.

Another more recent form of terminal connection heretofore used in some electrical connectors utilized an insulation displacement contact (IDC) device. Here, the end of an insulated wire is forced between opposing knife edges of a blade like connector element. Examples of such IDC type elements are shown in U.S. Pat. Nos. 4,444,448 and 4,701,138. In the former patent a cap and body telescope together to force wires into the IDC contact element, and in the latter patent, an applicator block mechanically linked to a lever on the housing is used to move the wire into the receiving portion of the IDC terminal. Previous connector devices using IDC terminals have utilized a plurality of complicated interfitting components, and in some instances the resulting terminal connection was unreliable.

It is therefore one object of the present invention to provide an electrical connector unit having an improved system for terminating or connecting wires to rigid IDC type connector terminals within the unit.

Another object of the invention is to provide an electrical connector with an IDC type wire termination system that can be quickly and easily installed with one simple tool by a relatively unskilled person.

Another object of the invention is to provide an electrical connector unit with a wire termination system that is electrically reliable when assembled and can be easily disassembled for repair or change in wire size if desired.

A more specific object of the invention is to provide an electrical connector assembly with an IDC type wire termination system which includes a slidable block with one opening for retaining the end of a wire, the block being movable by a simple tool such as a screwdriver which can be inserted through a second opening in the block for moving the block and thus the wire retained by it into firm contact with an IDC terminal, and further including means for locking the block in position when the electrical wire/terminal contact is made.

Yet another object of the invention is to provide an electrical plug connector having a lockable wire terminating system that is particularly well adapted for ease and economy of manufacture.

BRIEF SUMMARY OF THE INVENTION

In accordance with the invention an electrical connector is disclosed which comprises an open housing that retains a plurality of male or female connector pins or sockets, each of which is connected to an IDC connector that extends inwardly within the housing. Each IDC connector has an extended jaw section formed by a bifurcated blade which is aligned with an elongated chamber. Within said chamber is a slidable block that has a first hole for receiving the end of a wire to be connected and a second larger hole for temporarily receiving an installation tool. An integral cup-like structure is provided on the inside of the housing adjacent each block chamber to provide a supporting recess for the tool that will be used in moving the block. The aforesaid connector structure with its open housing is supplied by a manufacturer with its slidable blocks exposed to an end user who typically desires to attach the connector to an electrical cable having two, three or more wires. Within the housing in an open extended position, each wire to be connected to the connector plug unit is first placed into the small hole of a slidable block. The installer then uses a simple, straight bladed screwdriver by extending it through the larger hole of the block and into the support cup. With a short but firm lever action the block is moved within its chamber and against the jaws of the aligned IDC therein. As the slider block movement takes place, the IDC jaws cut the wire insulation and make a firm electrical contact with the conductive core of the wire. As each block is moved to its fully seated position with the wire therein in full electrical contact with the IDC jaws, a locking detent on the housing adjacent the block is engaged and produces a clicking sound and/or a small but obvious vibration that indicates that a full, proper contact and seating of the slider block has been achieved. After all slider blocks are properly seated with their wires connected, an operation that is quickly accomplished with only a screwdriver, the housing cover can be closed and secured to complete the connector assembly. The housing is preferably molded as a one-piece unit from a suitable plastic and is configured to have top and bottom cover sections which are foldable in a valise-like manner after the internal terminal wire connections have been made.

Other objects, advantages and features of the invention will become apparent from the following description of one embodiment thereof presented in conjunction with the accompanying drawing.

DETAILED DESCRIPTION OF EMBODIMENT

Figure 2:
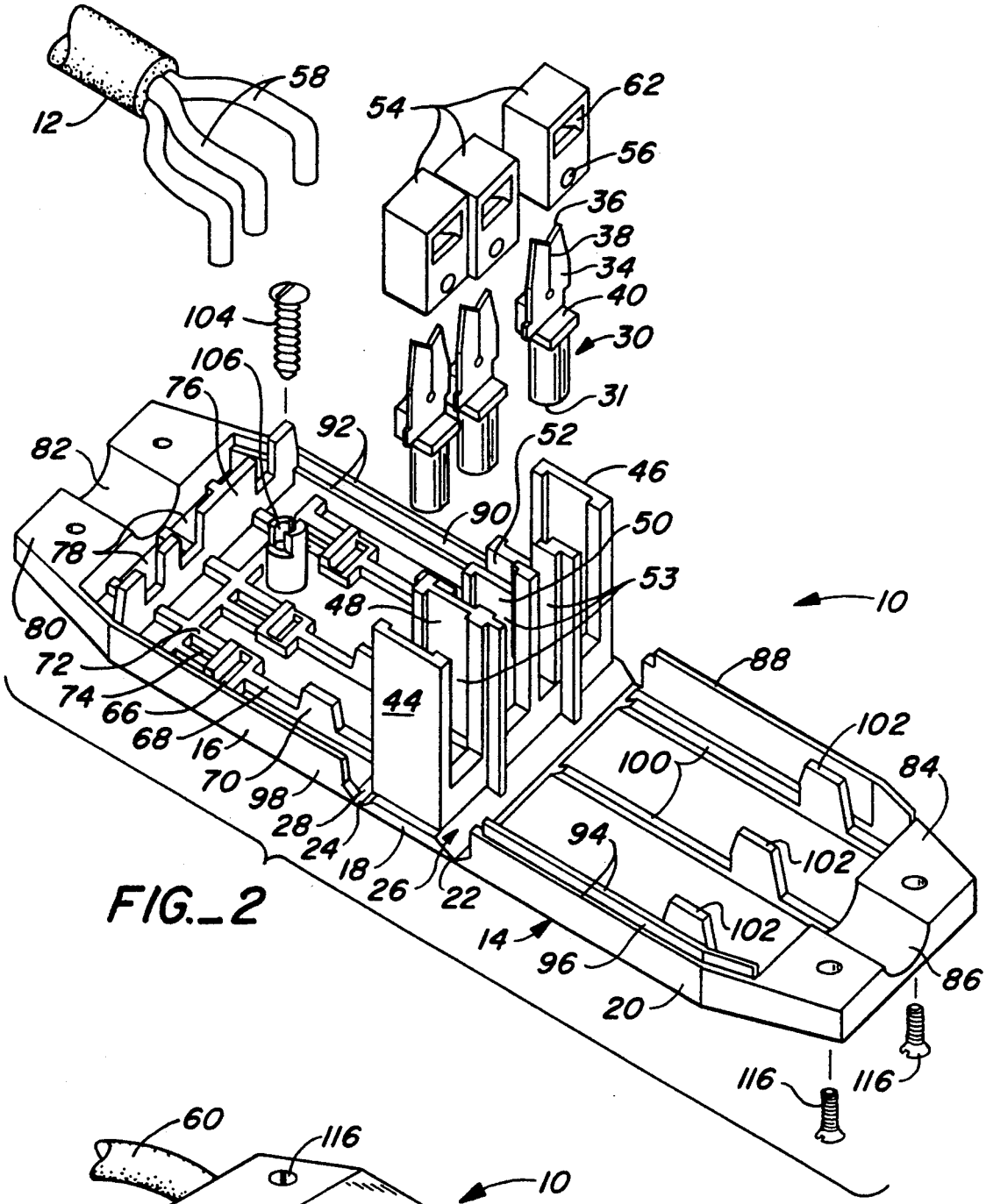
FIG. 2 is an enlarged exploded view in perspective of an electrical plug connector embodying principles of the present invention.
Figure 1:
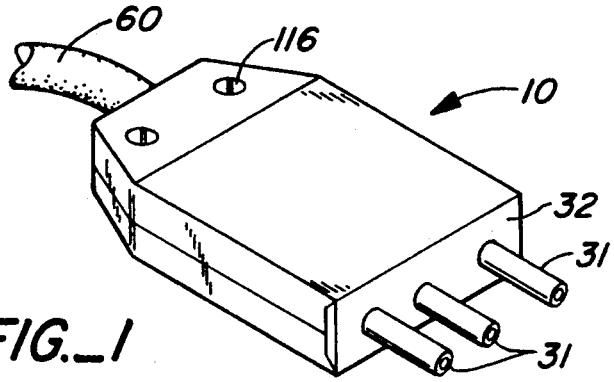
FIG. 1 is a view in perspective showing an assembled plug connector according to the invention.

With reference to the drawing, FIG. 1 shows an electrical plug connector 10 embodying the present invention as it appears when fully assembled and ready for use, and FIG. 2 shows the same plug connector in an exploded view before being assembled. In the example used to illustrate features of the invention, a three wire male connector is shown to accommodate a standard three wire conduit 12. However, it should be apparent that the invention can also be applied to female plug connectors and to electrical connector devices having a different number of wires.

In broad terms, the present invention provides a unique wire termination system for a plug connector as will be demonstrated by the following detailed description. A housing 14 for the plug connector 10 is preferably formed by molding a plastic material (e.g. nylon) in a single piece. As shown in FIG. 2, the housing is molded to form generally three sections, namely a bottom cover section 16, a center or internal section 18 and a top cover section 20. The bottom cover section and the top cover section are integral with the center section in that they are connected thereto by a pair of thin web sections 22 and 24 which form the bottom portion of a pair of transverse grooves 26 and 28. These web sections each provide a hinge means that enables the bottom and top cover sections 16 and 20 to be folded toward the center section 18 when the connector is fully assembled.

Fixed within the plug connector 10 as it is assembled, are rigid conductive terminal connectors which may have either a male prong or female socket configuration. For purposes of illustration, the terminal connectors 30 which are illustrated are of the male type and have a cylindrical prong 31 which projects from the outer end wall 32 of the center housing section 18. As shown in FIG. 2, each terminal connector 30 is attached to a pair of narrowly spaced apart insulation displacement contact (IDC) blades 34 having tapered outer ends 36 and relatively sharp opposed inner edges 38.

In constructing the terminal connector, the prong portion 31 may be integral or a separate piece which is riveted or welded to the blade section as shown in FIG. 1. Between the blades 34 and the prong 31 on each terminal conductor 30 is provided a transerve tab portion 40 that serves to position the connector 30 in the center section 18 of the plug connector housing 14. Thus, in the plug connector 10, the prong 31 of each terminal connector 30 extends through a hole 42 formed in the outer end wall 32 of the housing center section 18 with the tab portion 40 serving as a positioning means and bearing against the inside surface of the outer end wall 32.

In the embodiment shown in FIG. 2, the plug connector 10 has a center section 18 with three holes for accommodating three terminal connectors. These holes are spaced apart in the transverse outer end wall 32 which ultimately forms the forward end surface of the fully assembled connector 10 as shown in FIG. 1.

Extending upwardly from opposite sides of each hole in the outer end portion 32, as shown in FIG. 2, are a series of spaced apart projections 44–52 which together are shaped and positioned so as to serve as guide means for a plurality of movable actuator blocks 54, also shown in FIG. 2. Projections 44 and 46 at opposite ends of the center section 18 have a channel shaped cross section, and intermediate projections 48, 50 and 52 are similarly shaped to form elongated chambers 53 between the projections to receive and slidably retain the actuator blocks 54 when the center section 18 is bent at the web 22 to move into the bottom cover section 16. (See FIG. 4)

Figure 5:
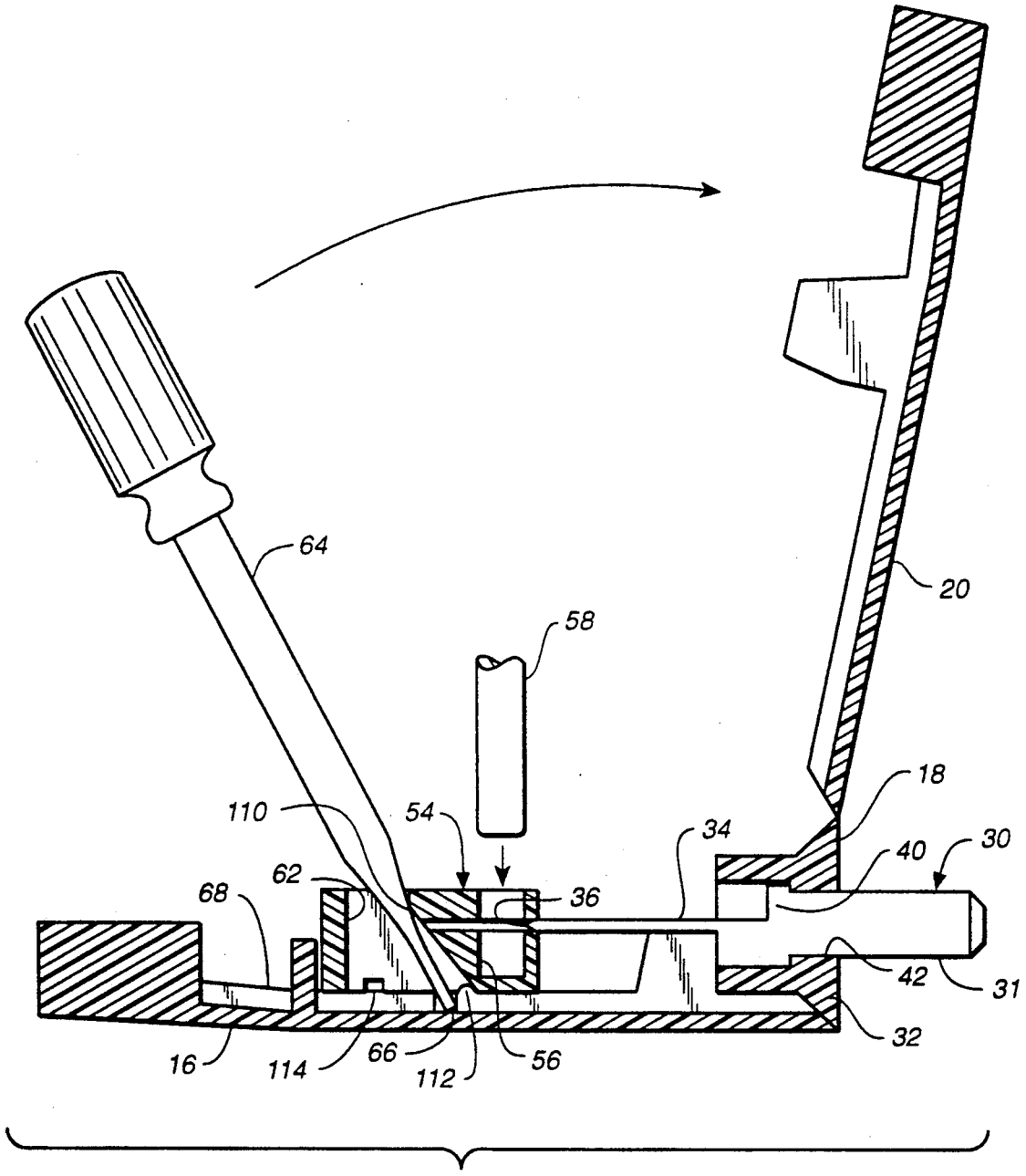
FIG. 5 is a view in side elevation and in section of a plug connector according to the present invention, showing one slider block before a wire has been attached and the slider block has been fully installed by a tool, shown in phantom.

Each actuator block, which may be made of a non-conductive material, such as a suitable plastic (e.g. nylon) has a generally oblong shape so that it fits slidably within a chamber 53 formed between the projection 44–52 of the center section 18. Also, each actuator has a relatively small hole 56 near one end for receiving the end of an insulated wire 58, as from the standard three wire conduit 12. Near the other end of each actuator block is a larger rectangular shaped hole 62 that is adapted to receive, temporarily, a prying or lever producing tool such as a conventional screwdriver 64, as shown in FIG. 5.

Figure 3:
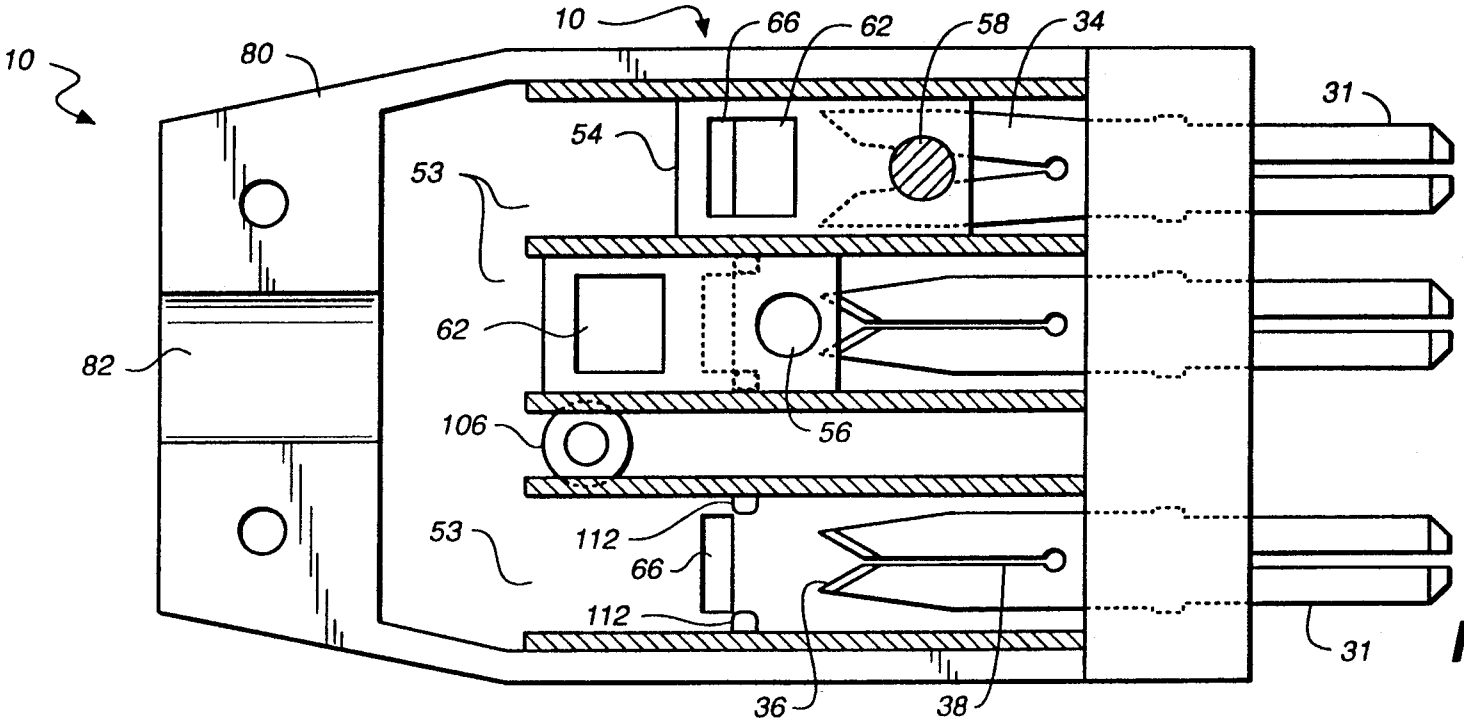
FIG. 3 is an enlarged plan view, partially in section of a plug connector according to the invention, showing two slider blocks in different positions and a third slider block in phantom.
Figure 6:
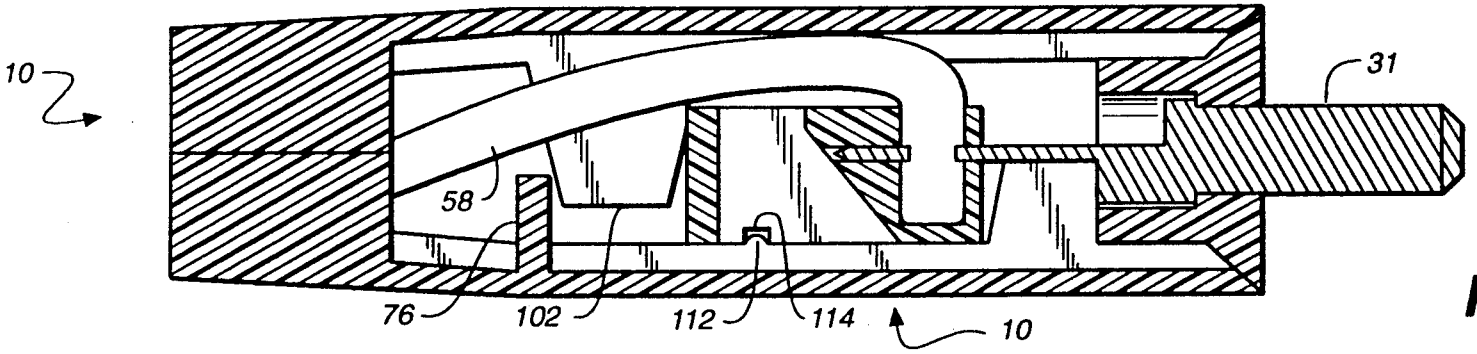
FIG. 6 is an enlarged view in elevation and in section showing the plug connector of FIG. 5A with its cover fully closed.

In FIG. 3, the connector 10 is shown with its top cover section 20 removed so that the actuator blocks 54 can be seen in their chambers 53. In the upper chamber, the block 54 is in its fully installed position with the wire 58 between the blades 34 in the contact position. In the middle chamber the block is shown as it appears before being moved into contact position. In the lower chamber 53, no block is shown so that the pocket 66 for receiving the lever tool can be readily seen. Normally, block would be in this chamber for installation like the other actuator blocks.

Turning again to FIG. 2, the bottom cover section 16 is formed internally with a series of spaced apart recesses or pockets 66 for receiving one end of the prying tool or screwdriver 64. Extending between each pocket 66 and the center section 18 is an integral ridge 68. Each of these ridges has an upwardly extending integral tab position 70. On the other outer side of each pocket 66 are additional ridge portions 72 forming an elongated shallow groove 74. Spaced from the ends of these grooves 74 is a transverse internal divider 76 having spaced apart rectangular notches 78 for guiding and retaining the wires 58 of the conduit 12 attached to the plug connector 10. Spaced outwardly from the divider 76 is the outer end portion 80 of the bottom housing section which is relatively thick and has a semi-cylindrical recess 82 to accommodate the attaching conduit 12.

The top cover section 20 has a plan form shape which is similar to that of the bottom cover section 16. It has a relatively thick outer end portion 84 with a semi-cylindrical recess 86 which is adapted to fit against the outer end portion 80 of the bottom cover section 16 when the two cover members are closed. Also, it has a single thickness side-wall 88 which is adapted to fit within a pocket 90 formed by the double side wall 92 of the bottom cover section 16. Similarly, a double side wall 94 on the top section 20 forms an elongated pocket 96 for receiving a single side wall 98 of the bottom cover section. Spaced between opposite side walls on the inside surface of the top cover section are three ridge members 100, each having an upwardly projecting tab member 102 that is spaced a predetermined distance from the hinge portion 22.

Figure 4:
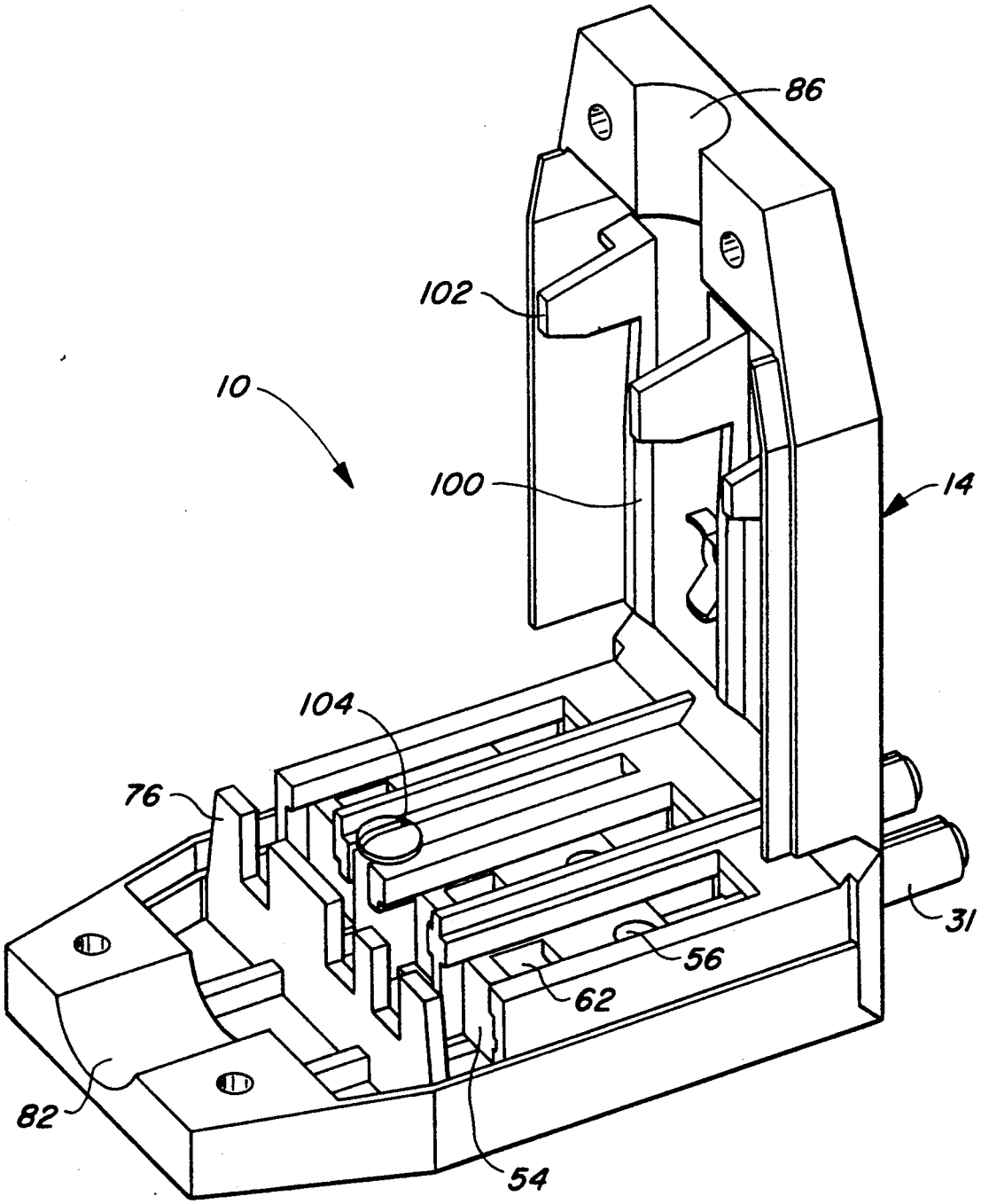
FIG. 4 is a view in perspective showing the plug connector of FIG. 1 with one side cover member in the open position.

In accordance with the principles of the present invention, the plug connector 10 is assembled in two stages. The first stage of assembly is accomplished at a factory for producing the plug connector 10 with its top cover 20 open, with its terminal IDC connectors 30 fixed in position and with its slidable actuator blocks 54 loosely installed within the chambers 53 and ready to receive wires 58 of a conduit 12 before the top cover section 20 is closed. Thus, as shown in FIG. 4, the center housing section 18 is shown after being bent over and nested into the bottom cover section 16. When in this position the center section is retained by a single screw 104 which is seated within a tubular boss 106 that extends upwardly from the inside surface of the bottom cover section. The head of screw 104 bears against upper surfaces of upright members 50 forming a slot 108. This locks the actuator blocks 54 within their chambers 53 between the guide members 44–52 so that they are each slidable between a pair of guide members.

Figure 5A:
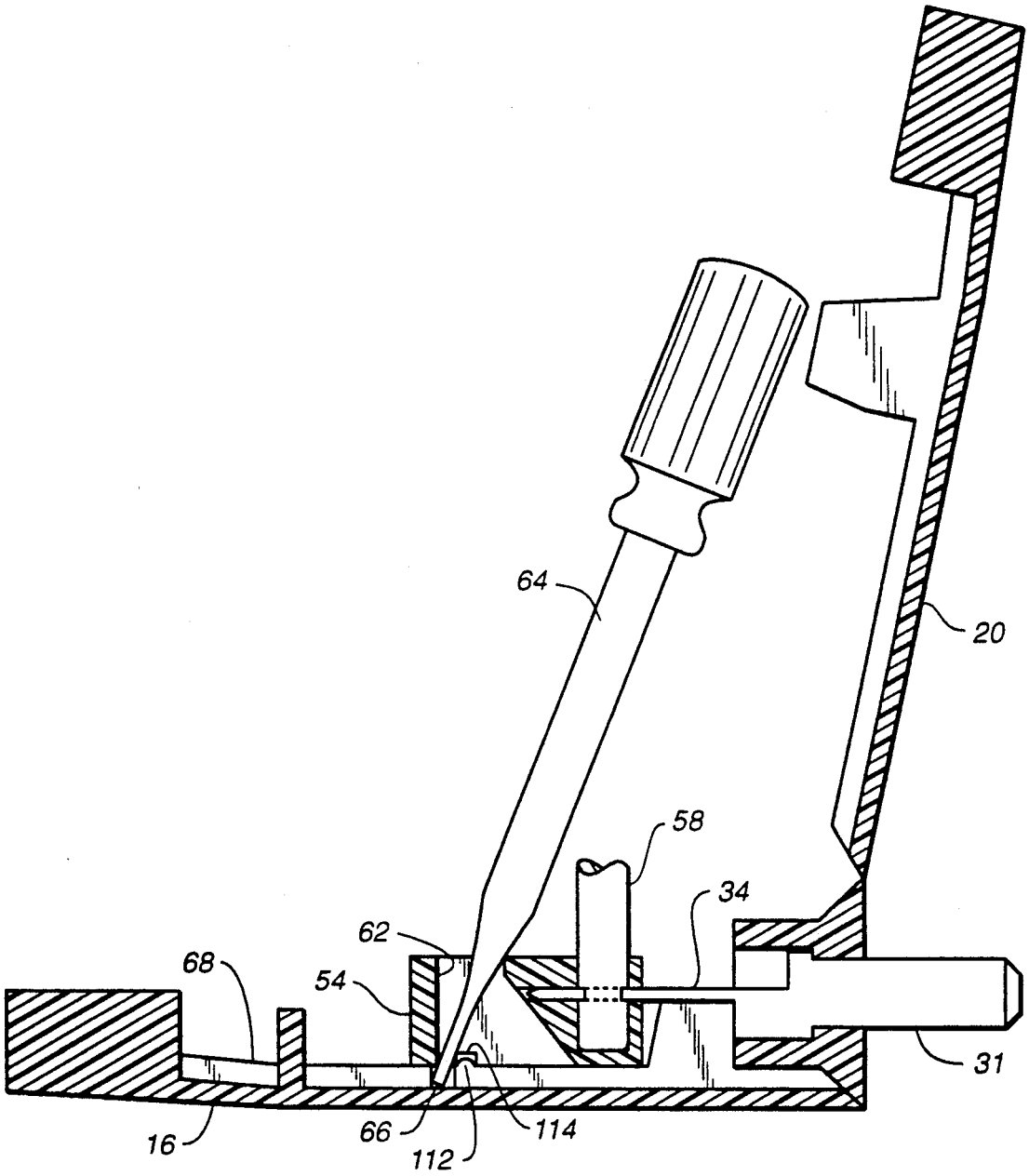
FIG. 5A is a view in elevation and in section similar to FIG. 5, and showing the slider block in its fully seated position.
Figure 7:
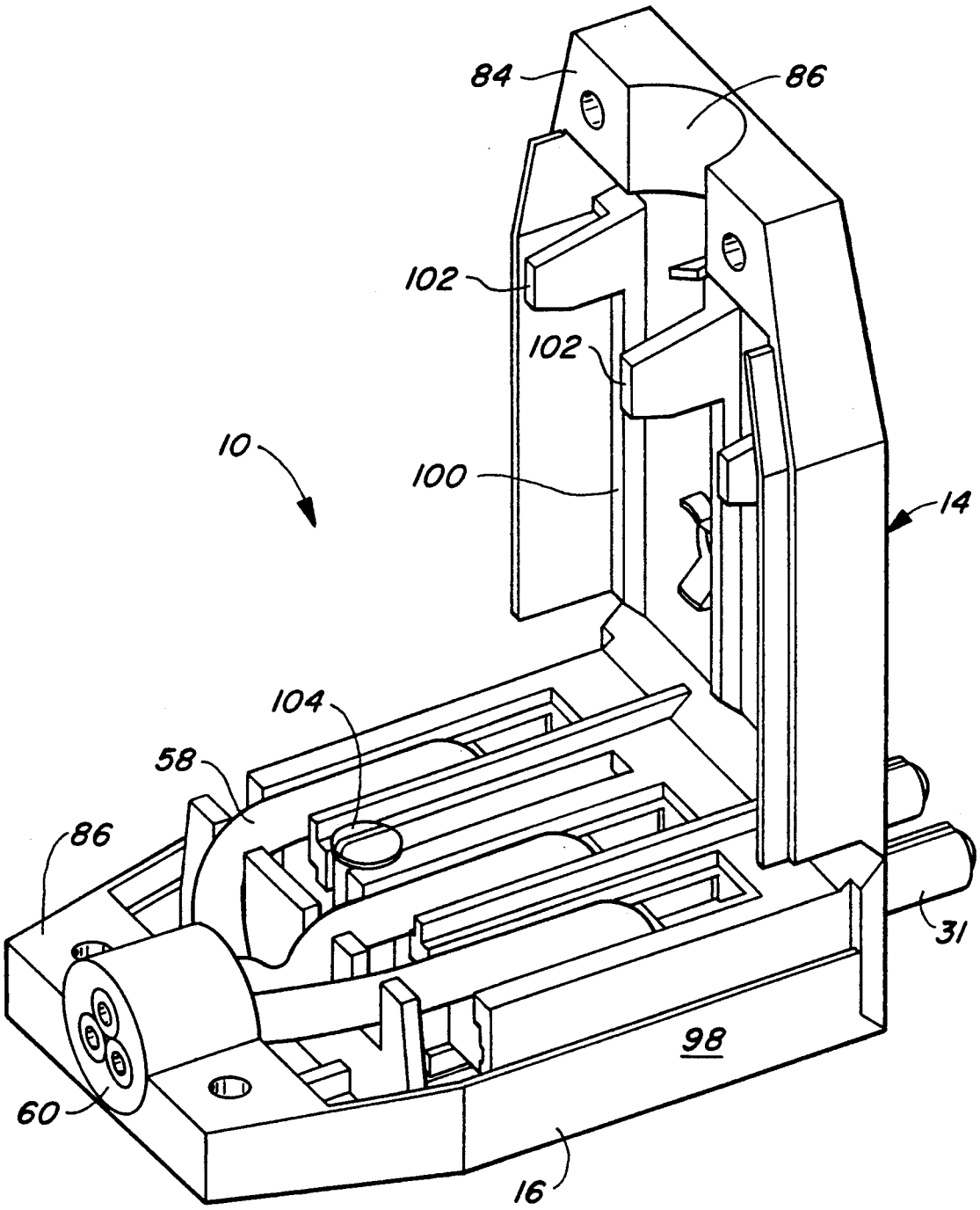
FIG. 7 is a view in perspective of a plug connector according to the invention with one cover section open and showing the connected wires in place and extending to a single conduit.

Now, referring to FIGS. 5 and 5A, when a conduit 60 is connected to the plug connector 10, a lever type tool such as a screwdriver 64 is used. With each actuator 54 retracted to a rear standoff position as shown in FIG. 5, one wire 58 of the conduit 12 is inserted into and pushed to the bottom of the round hole 56 of an actuator 54. The screwdriver 64 is now inserted through the access hole 62 of the actuator with its tip extending into a pocket 66 of the lower cover section 16. Now, the screwdriver is pivoted forwardly, as indicated in FIG. 5A, and exerts a moving force at a point 110 on the actuator to move the latter and the retained wire 58 between the bifurcated blades 34 of the fixed IDC connector 30 in the plug connector. As shown in FIG. 5A, the actuator 54 is moved to its terminal position wherein a small projection 112 on a ridge member 68 of the lower cover member 16 is aligned with and seated in a complimentary notch 114 in the bottom side of the actuator. As this projection 112 becomes seated in the notch, the installer will sense, by feel or sound that such seating of the actuator has taken place, thereby indicating that the actuator has reached its proper terminal position. As the actuator moves to its terminal position, the blades 34 of the connector move 36 into the wire 58 through its insulation and form a firm and permanent electrical contact with the conductive portion of the wire.

When all of the actuators 54 with wires 58 of the conduit 12 have been moved within their respective chambers 53 into their terminal positions with the IDC blades 34 in the manner described, the separate wires are arranged to extend through the appropriate slots 78 in the divider member 76, and the conduit 12 itself is seated in the semi-cylindrical recesses 82 of the lower cover section 16. The installer can now fold down the top cover section 20 so that it closes against the lower cover section 16. As this occurs, the tab members 102 of the top cover section 20 serve as stop means and become positioned at the ends of the installed actuators 54, thereby further assuring that they cannot move backward from these terminal position with the IDC blade members 34. After the cover members are closed together, two screws 116 are provided through the engaged outer end positions 82 and 86 on opposite sides of the conduit 12 retained between them, to secure the assembled plug connector 10.

From the foregoing, it should be apparent that the present invention provides an efficient device that enables a multi-wire conduit to be terminally connected with minimal time and labor to provide a safe, durable and effective electrical plug connector assembly.

To those skilled in the art to which this invention relates, many changes in construction and widely differing embodiments and applications of the invention will make themselves known without departing from the spirit and scope of the invention. The disclosure and the description herein are purely illustrative and are not intended to be in any sense limiting.

What is claimed is:

1. An electrical plug connector adapted for connection with individual wires of an electrical conduit, comprising:

a housing;

means in said housing forming a plurality of elongated chambers;

a plurality of electrical coupling elements fixed in said housing, each said coupling element including an elongated bifurcated jaw section having opposed inner knife edges and extending within a said chamber means;

a slider block within each said housing chamber; each said slider block including a first hole for receiving the end of an insulated wire to be terminally attached to a said coupling element and a second hole which diverges inwardly from an upper surface of said slider block and forms a fulcrum for receiving a tool adapted to move said slider block; said slider block being movable within its chamber toward a said jaw section of said coupling element so that said wire previously placed within said slider block will move between said knife edges of said jaw section to provide an electrical contact.

2. The plug connector as described in claim 1 wherein said housing supports three coupling elements and provides three elongated chambers for each said element, with a slider block in each said chamber.

3. The plug connector as described in claim 1 wherein said housing is formed as a unitary device of molded plastic material.

4. The plug connector as described in claim 3 wherein said plastic material is a non-conductive plastic material.

5. The plug connector as described in claim 1 wherein said housing is formed as a unitary molded plastic device having top and bottom cover sections each connected by a web member to an intermediate center section including said chamber means.

6. The plug connector as described in claim 5 wherein said center section has a series of spaced apart projecting members shaped to retain said slider blocks and to fit within said bottom cover section, leaving said top section open until after said slider blocks have been connected to their respective coupling elements.

7. The plug connector as described in claim 1 wherein said bottom cover section includes recess means adapted to support the end of a tool for moving a slider block against a jaw section of said coupling element.

8. The plug connector as described in claim 5 wherein said top cover means includes tab means for retaining each said slider block in its fully installed position relative to a said coupling element when said cover means are closed.

9. The plug connector as described in claim 5 wherein said top and bottom cover sections each have a first sidewall of material having a single thickness and a second sidewall of material having spaced apart members forming a pocket, wherein the first sidewall of each cover section is adapted to fit into said pocket of the second sidewall when said cover members are closed.

10. The plug connector as described in claim 1 wherein said coupling elements are made of electrical conductive material, each having a forward prong portion which extends outwardly from said housing and is connected to said bifurcated jaw section.

11. The plug connector as described in claim 1 including indicator means in said slider block and said lower cover section for indicating to an installer when a said slider block has moved to a position wherein its wire is fully engaged with a said coupling element.

12. The plug connector as described in claim 11 wherein said indicator means includes a small projection on said bottom cover section and a matching detent recess in a said slider block.

* * * * *